US011920420B2

(12) United States Patent
Wankan

(10) Patent No.: US 11,920,420 B2
(45) Date of Patent: Mar. 5, 2024

(54) WASHOVER TOOLS, SYSTEMS, AND METHODS OF USE

(71) Applicant: Robert Dwayne Wankan, Lufkin, TX (US)

(72) Inventor: Robert Dwayne Wankan, Lufkin, TX (US)

(73) Assignee: Robert Dwayne Wankan, Lufkin, TX (US)

( * ) Notice: Subject to any disclaimer, the term of this patent is extended or adjusted under 35 U.S.C. 154(b) by 88 days.

(21) Appl. No.: 17/571,036

(22) Filed: Jan. 7, 2022

(65) Prior Publication Data

US 2022/0228454 A1 Jul. 21, 2022

Related U.S. Application Data

(60) Provisional application No. 63/140,146, filed on Jan. 21, 2021.

(51) Int. Cl.
*E21B 31/18* (2006.01)
*E21B 29/00* (2006.01)

(52) U.S. Cl.
CPC ..... *E21B 31/18* (2013.01); *E21B 29/00* (2013.01)

(58) Field of Classification Search
CPC ..... E21B 31/03; E21B 31/18; E21B 29/00; E21B 17/10
See application file for complete search history.

(56) References Cited

U.S. PATENT DOCUMENTS 3,289,767 A * 12/1966 Seward ..... E21B 17/1028 166/241.7
3,804,186 A * 4/1974 Schoeffler ..... E21B 21/10 175/317
4,030,745 A * 6/1977 Schoeffler ..... E21B 31/18 294/86.28
4,545,432 A 10/1985 Appleton
5,810,410 A * 9/1998 Arterbury ..... E21B 31/12 294/86.17
2018/0283118 A1* 10/2018 Vander Velde ..... E21B 31/125

OTHER PUBLICATIONS

Canadian Examination Report dated Oct. 31, 2023, for Canadian Patent Application No. 3,146,631.

* cited by examiner

*Primary Examiner* — Christopher J Sebesta
(74) *Attorney, Agent, or Firm* — Patterson + Sheridan, LLP

(57) ABSTRACT

A washover tool including an inner housing and an outer housing forming an enclosed annulus. The washover tool includes a rod member coupled to the outer housing, the rod member configured to supply a fluid to the annulus. The washover tool includes a front face plate having a plurality of openings in fluid communication with the annulus. The annulus of the washover tool is configured to receive a fluid through the rod member and configured to eject the fluid through the plurality of openings of the front face plate to washover a pipe embedded in a ground.

20 Claims, 6 Drawing Sheets

WASHOVER TOOLS, SYSTEMS, AND METHODS OF USE

CROSS-REFERENCE TO RELATED APPLICATIONS

This application claims benefit of U.S. Provisional Patent Application Ser. No. 63/140,146, filed Jan. 21, 2021, which is herein incorporated by reference in its entirety.

BACKGROUND

Field

The disclosure relates to pipe removal systems and methods and associated components thereof that include a washover tool for underground pipe removal.

Description of the Related Art

Pipelines are designed to transport products, such as sewage, water, or petroleum products, including oil and gas, between two different locations. These pipelines are typically steel or plastic tubes which may be buried underground. Processes and tools currently used in the art require craftsmen to sequentially dig up and cut out sections of the pipe from beneath the ground. Accordingly, these processes and tools used to remove these pipelines are extremely time consuming and often require highly skilled labourers, costly equipment, and dangerous conditions.

These pipelines are often installed using the Horizontal Directional Drilling method (or "HDD"). Drilling machines utilize drilling rods or drill pipe that sometimes become stuck in the ground during the HDD process. When the drilling rods or pipe become stuck, in most cases, the rods or pipe are abandoned and a new pilot hole is created, because as stated above the processes and tools required to remove the suck rods or pipe are extremely burdensome.

Therefore, there is a need for a new and improved tools for underground pipe removal.

SUMMARY

Implementations of the present disclosure relate to pipe removal systems, and methods of using pipe removal systems to remove underground pipes.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figures 1A, 1B, 1C:
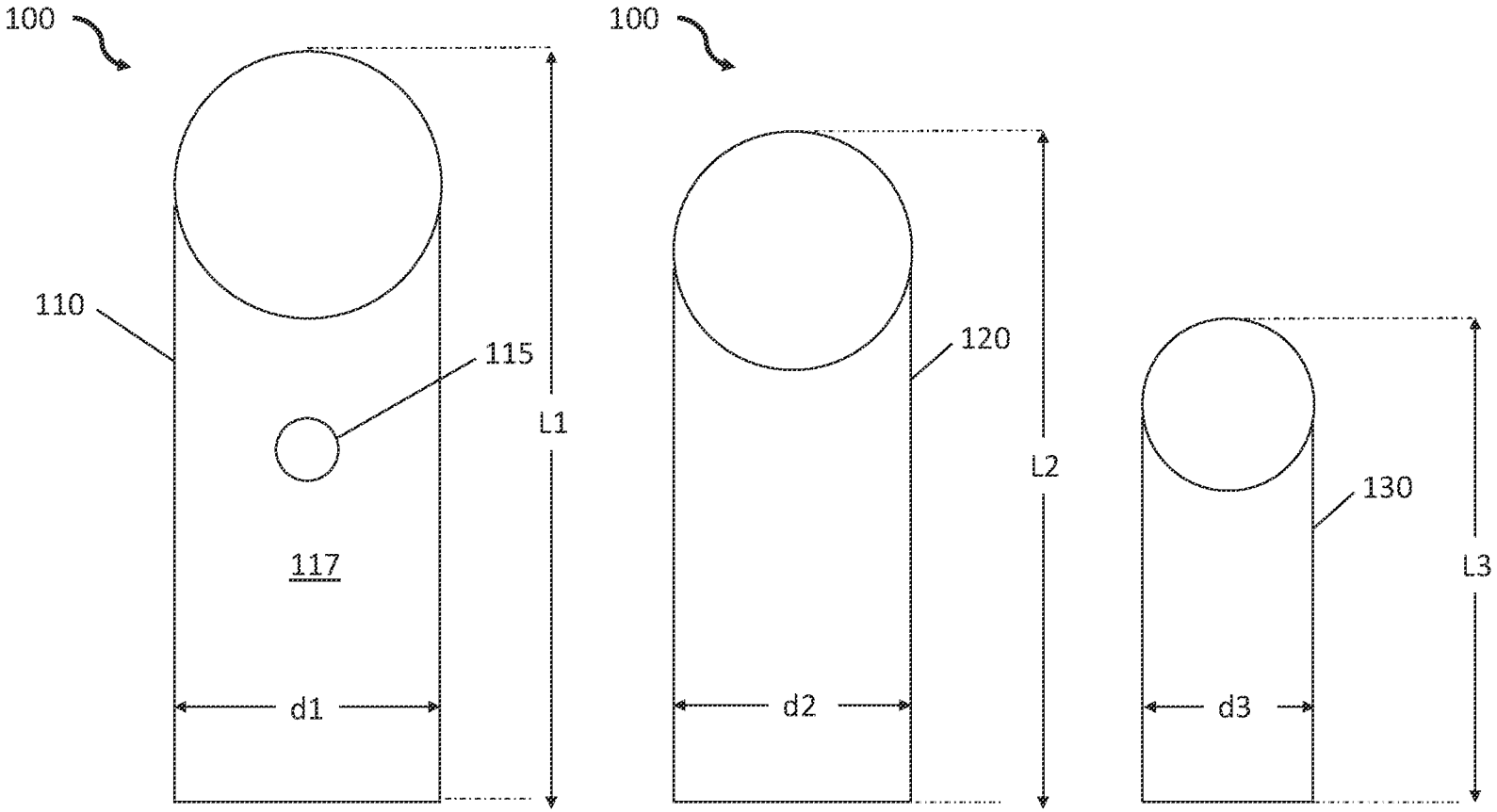
FIGS. 1A, 1B, and 1C are top views of an outer housing and an inner housing of a washover tool, and a top view of a pipe, according to one or more embodiments.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the disclosure relate to pipe removal systems, and methods for using pipe removal systems to remove underground pipes. In one aspect, the disclosure relates to a washover tool system, and methods of using the washover tool system.

Figure 3B:
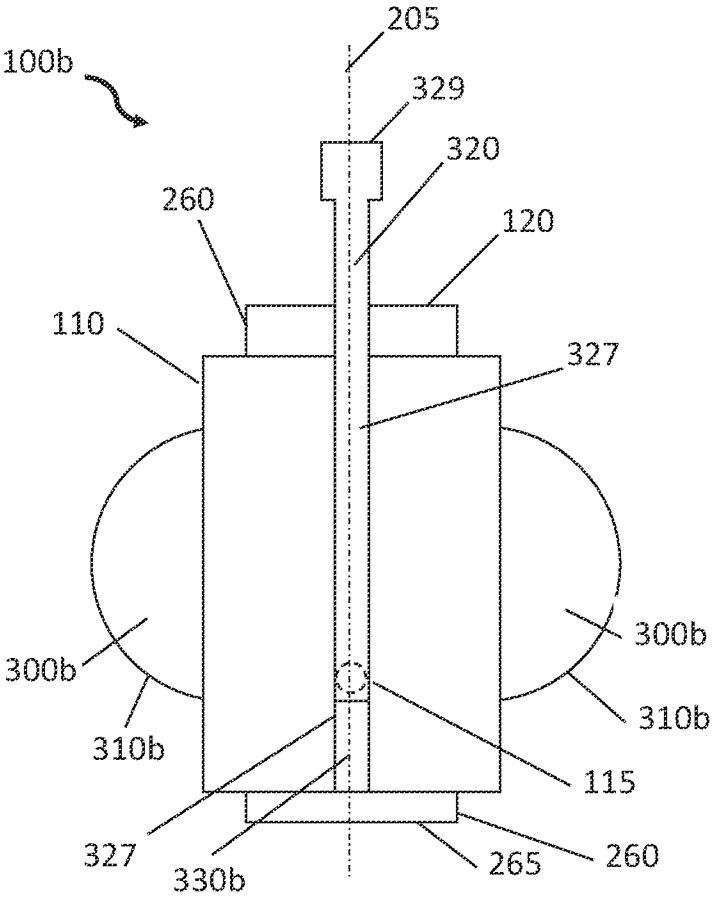
FIGS. 3A and 3B are top views of washover tools with a rod member and one or more stabilization members, according to one or more embodiments.
Figure 3A:
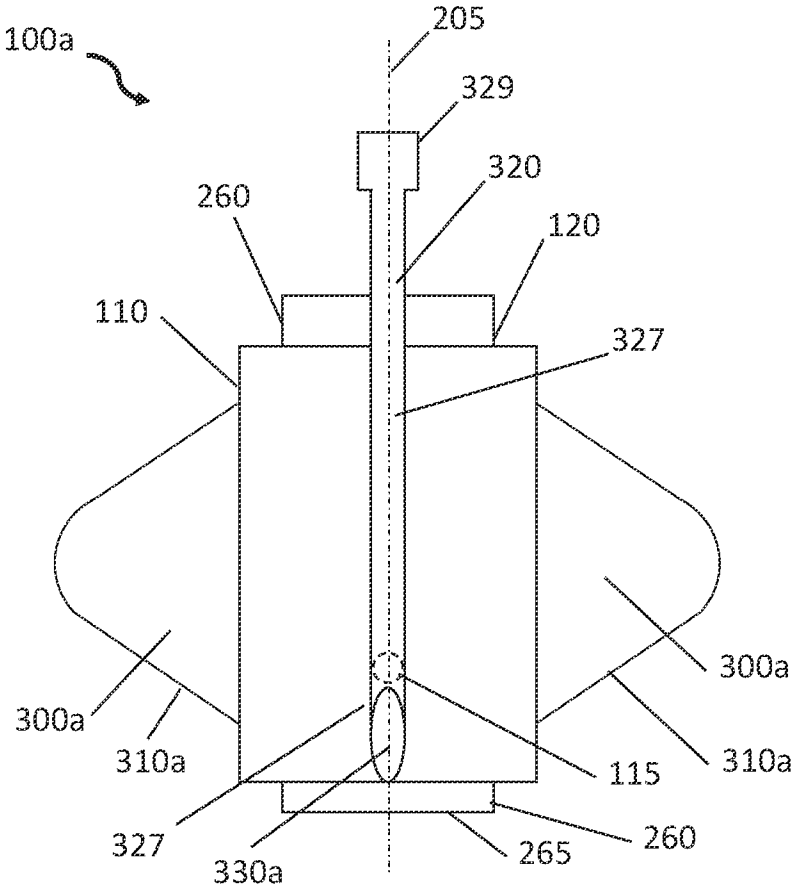

FIGS. 1A and 1B are top views of an outer housing 110 and an inner housing 120 of a washover tool 100 (more fully illustrated as washover tools 100*a*, 100*b* in FIGS. 3A and 3B, respectively). When assembled, the inner housing 120 is positioned within the outer housing 110. FIG. 1C illustrates a pipe 130 that can be washed over by the washover tool 100 and removed from being buried underground.

The outer housing 110 is a cylindrical pipe having an outer diameter d1*a*, an inner diameter d1*b* (illustrated in FIG. 2A), and a length L1. The outer diameter d1*a* may be within a range of 1.0 inches to 60 inches. The inner diameter d1*b* (illustrated in FIG. 2A) may be within a range of 0.90 inches to 59.9 inches. The length L1 may be within a range of 0.2 feet to 50 feet. An upper opening 115 is formed through a top side 117 of the outer housing 110. The upper opening 115 allows the outer housing 120 to receive a fluid, such as wash water, for washing over the pipe 130 as further described below.

The inner housing 120 is a cylindrical pipe having an outer diameter d2*a*, and inner diameter d2*b* (illustrated in FIG. 2A), and a length L2. The outer diameter d2*a* may be within a range of 0.75 inches to 59.75 inches. The inner diameter d2*b* (illustrated in FIG. 2A) may be within a range of 0.65 inches to 59.65 inches. The length L2 may be within a range of 0.2 feet to 50 feet. In some embodiments, the length L1 of the outer housing 110 is the same as length L2 of the inner housing 120. In some embodiments, the length L2 of the inner housing 120 is greater than the length L1 of the outer housing 110.

FIG. 1C illustrates the pipe 130 having an outer diameter d3 and a length L3, all or portions of which may be buried underground in a vertical orientation, a horizontal orientation, and/or at an angled orientation between vertical and horizontal. The outer diameter d3 may be within a range of 0.50 inches to 60 inches. The inner diameter may be within a range of 0.40 inches to 59.9 inches. The length L3 may be within a range of 1.0 feet to 5,280 feet.

The outer housing 110 is larger in diameter than the inner housing 120. The difference in diameters of the outer and inner housings 110, 120 creates an annulus 220 (illustrated in FIG. 2A) between the two housing for receiving a high-pressure fluid, such as water or a drilling mud slurry, that flows out of the washtool 100. The actual diameters of the outer and inner housings 110, 120 can be varied, as long as there is an adequate annulus 220 between the outer and inner housings 110, 120 for fluid flow. The size of the inner housing 120 relative to the pipe 130 to be removed may depend on the ground conditions that the pipe 130 is buried or stuck in, but the inner housing 120 should be large enough to slip over the pipe 130 freely. The lengths L1, L2 of the outer and inner housings 110, 120 can vary depending on jobs side conditions and/or customer preferences. In some embodiments, the length L1 of the outer housing 110 is the same as length L2 of the inner housing 120. In some embodiments, the length L2 of the inner housing 120 is greater than the length L1 of the outer housing 110.

In operation, the washover tool 100 is positioned circumferentially around the pipe 130 such that the pipe 130 extends through the inner housing 120. The washover tool 100 is moved along the length L3 of the pipe 130 while spraying a wash fluid to washover the pipe 130 to remove dirt, debris, and/or the ground surrounding the pipe 130. The pipe 130 may be any type or size used to transport fluids, solids, and/or mixtures of fluids and solids, including but not limited to oil and gas. The pipe 130 may also be any type or size of drill rod or drill pipe utilized by an HDD or road boring machine.

Figure 2B:
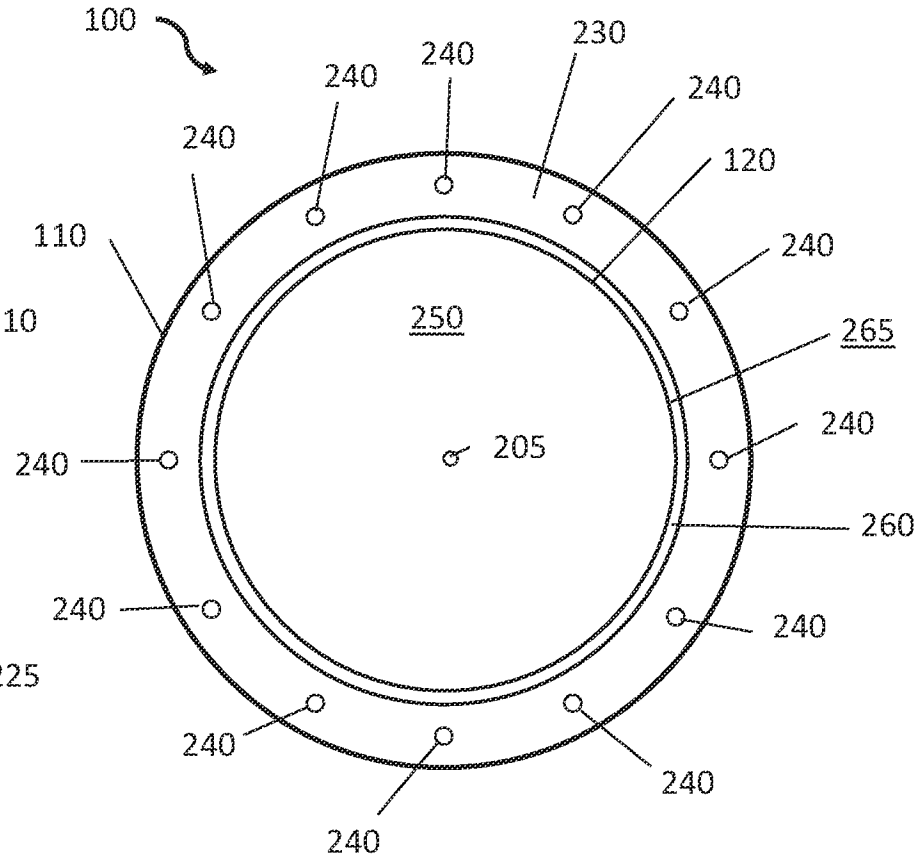
FIG. 2B is a front view of a portion of a washover tool, according to one or more embodiments.
Figure 2A:
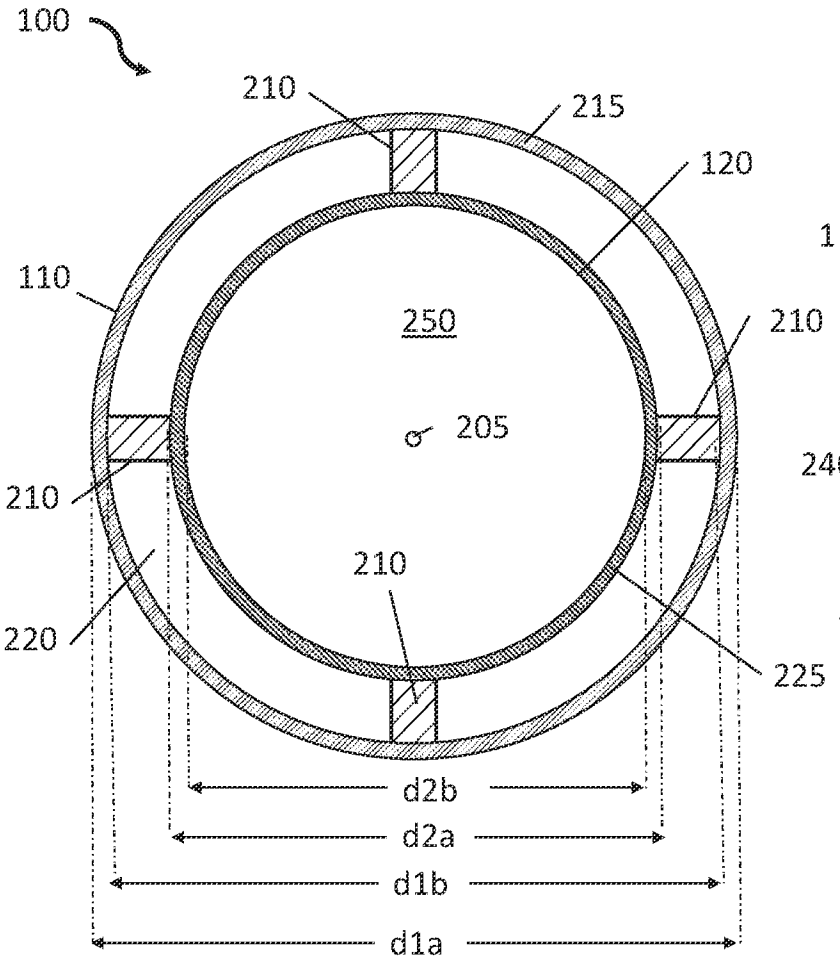
FIG. 2A is a cross-sectional front view of a portion of a washover tool, according to one or more embodiments.

FIG. 2A is a cross-sectional front view of only a portion of the washover tool 100, according to one or more embodiments. The inner housing 120 is positioned circumferentially within the outer housing 110. The inner diameter d2*b* of the inner housing 120 is greater than the outer diameter d3 of the pipe 130, so as to allow the washover tool 100 to be positioned around the pipe 130. The inner diameter d2*b* defines the bore 250, in which the pipe 130 is located when the washover tool 100 is used to washover the pipe 130.

The inner diameter d1*b* of the outer housing 110 is greater than the outer diameter d2*a* of the inner housing 120, as to form an annulus 220 between the outer housing 110 and the inner housing 120. The difference between the inner diameter d1*b* of the outer housing 110 and the outer diameter d2*a* of the inner housing 120 determines the width of the annulus 220. The width of the annulus 220 may be within a range of 2 inches to 24 inches. The width of the annulus 220 may be large enough to provide sufficient fluid flow to washover the pipe 130.

The outer housing 110 has a thickness 215. The thickness 215 of the outer housing 110 may be within a range of 0.10 inches to 2.0 inches. Additionally, the inner housing 120 has a thickness 225. The thickness 225 of the inner housing 120 may be within a range of 0.10 inches to 2.0 inches. In some embodiments, the thickness 215 and the thickness 225 are the same. In some contemplated embodiments, the thickness 215 and the thickness 225 are different. The thickness of the outer housing 110 and the inner housing 120 may be thick enough to allow proper welds to be made to assemble the washover tool 100.

The washover tool 100 further includes a plurality of centering members 210 disposed between the outer housing 110 and the inner housing 120 to center the outer and inner housings 110, 120, and to provide structural support to the washover tool 100 and the annulus 220. In some embodiments, the centering members 210 are metal blocks welded to the inner housing 120 and the outer housing 110 and disposed within the annulus 220. The centering members 210 may be radially spaced within the annulus 220 and may only extend along a portion of the length of the inner and/or outer housings 110, 120.

FIG. 2B is a front view of only a portion of the washover tool 100, according to one or more embodiments. The washover tool 100 includes a front face plate 230 that covers the annulus 220. The front face plate 230 is welded to an end or front surface of the outer housing 110 and to the outer surface of the inner housing 120 such that an outer edge portion 260 of the inner housing 120 extends from the outer housing 110 (e.g. the length of the inner housing 120 is longer than the length of the outer housing 110). In some embodiments, the front face plate 230 may be welded to the outer and inner housings 110, 120 such that the front face plate 230 covers the ends or front surfaces of the inner and outer housings 110, 120 (e.g. the length of the inner housing 120 is the same as the length of the outer housing 110). In some embodiments, the front face plate 230 may be welded to the inner diameter of the outer housing 110 and the end or front surface of the inner housings 120 (e.g. the length of the outer housing 110 is longer than the length of the inner housing 120).

The washover tool 100 may similarly include a back face plate, which is disposed at an opposite end of washover tool 100 from the front face plate 230. The back face plate may be welded in a similar manner as the front face plate 230. Together, the front face place 230 and black face plate enclose the annulus 220 between the outer housing 110 and the inner housing 120.

The front face plate 230 includes a plurality of openings 240 formed through the front face plate 230, through which several jets or streams of wash fluid may flow through. The openings 240 may be radially positioned about the center axis 205 on the front face plate 230. The front face plate 230 includes enough openings 240 to allow for adequate fluid flow through the washover tool 100 to properly wash, loosen, and/or remove any material surrounding the pipe 130. For example, the front face plate 230 may include between four and five hundred openings 240 (although any number, orientation, and/or arrangement of openings 240 may be used) formed through the front face plate 230 radially about the center axis 205. Each opening 240 may be drilled, or drilled and tapped to allow for threaded opening inserts to be installed into the front face plate 230. The openings 240 and/or the threaded opening inserts may be sized to achieve a certain pressure of washover spray. For example, the openings 240 and/or the threaded opening inserts could be between 0.0001 inches and 1 inches. Each opening 240 and/or threaded opening insert could provide for an angle of spray between 0 degrees and 360 degrees. Each opening 240 allows fluid supplied to the washover tool 100 to spray from the washover tool 100 over the buried pipe 130. The wash fluid flowing out of the plurality of openings 240 washes over the pipe 130, thereby allowing the pipe 130 to be easily removed from the ground.

FIGS. 3A and 3B are top views of washover tools 100*a*, 100*b* with a rod member 320 and one or more stabilization members 300*a*, 300*b* coupled to the outer housing 110, according to one or more embodiments. The rod member 320 is a cylindrical pipe having a fixed end 325, an elongated body 327 and a receiving end 329 opposite the fixed end 325. The rod member 320 has a bore extending therethrough which receives a fluid and supplies the fluid to the annulus 220 formed between the outer housing 110 and the inner housing 120. The rod member further includes an opening 315 formed at the fixed end 325. The rod member is coupled to the top side 117 of the outer housing 110 and aligned in such a way that the opening 315 of the rod member 320 is axially aligned with the opening 115 formed in outer housing 110. By aligning the opening 115 and the opening 315, the bore of the rod member 320 and the annulus 220 are in fluid communication with one another. A fluid, such as a wash water, may be supplied from a control source 510 (illustrated in FIG. 5) through the rod member 320, into the annulus 220, and out of the openings 240 formed in the front face plate 230. In some embodiments, a tracking tool may be disposed within the rod member 320 to track the location of the washover tools 100*a*, 100*b* during operation.

The washover tools 100*a*, 100*b* may further include a cap 330*a*, 330*b* coupled to the fixed end 325 of the rod member 320 and the outer housing 110. As illustrated in FIG. 3A, the cap 330*a* is an ellipsis shape and has a width which is equal to the diameter of the rod member 320. As illustrated in FIG. 3B, the cap 330*b* is rectangular in shape, having a width which is equal to the diameter of the rod member 320. The caps 330*a*, 330*b* seal and close off the end of the rod member 320 to direct wash fluid into the annulus 220 formed between the inner and outer housings 120, 110.

FIGS. 3A and 3B further illustrate the washover tools 100*a*, 100*b* with a plurality of stabilization members 300*a*, 300*b*. The primary difference between the washover tools 100*a*, 100*b* are the shape of the stabilization members 300*a*, 300*b*, and the connection of the rod member 320 to the outer housing 120 as further described below with respect to FIGS. 4A and 4B. The stabilization members 300*a*, 300*b* prevent the washover tool 100 from rotating about the center axis 205 during operation. The stabilization members 300*a*, 300*b* include angled or rounded edges 310*a*, 310*b* that can be forced into the ground surrounding the buried pipe 130 to prevent rotation of the washover tools 100*a*, 100*b*.

FIG. 3A depicts the washover tool 100*a* with triangular stabilization members 300*a* coupled to the outer housing 110. FIG. 3B depicts the washover tool 100*b* with semi-circular stabilization members 300*b*. Each stabilization member 300*a*, 300*b* is coupled to the outer housing 110 of the washover tool 100. In some embodiments, the washover tools 100*a*, 100*b* include two stabilization members 300*a*, 300*b* coupled to the outer housing 110. The stabilization members 300*a*, 300*b* are coupled to the outer housing 110 at a position perpendicular to the positon that the rod member 320 is coupled to the outer housing 110. The washover tool 100 may include between two and eight stabilization members 300*a*, 330*b* (although any number, orientation, and/or arrangement of stabilization members 300*a*, 300*b* may be used) coupled to the outer housing 110 and spaced radially around the axis 205. In some embodiments, the washover tools 100*a*, 100*b* do not include any stabilization members 300*a*, 300*b*. In some embodiments, the stabilization members 300*a*, 300*b* have one or more openings to allow for the wash fluid supplied to the annulus 220 to be ejected from the stabilization members 300*a*, 300*b* to provide additional lubrication as the washover tools 100*a*, 100*b* move through the ground.

Figure 4B:
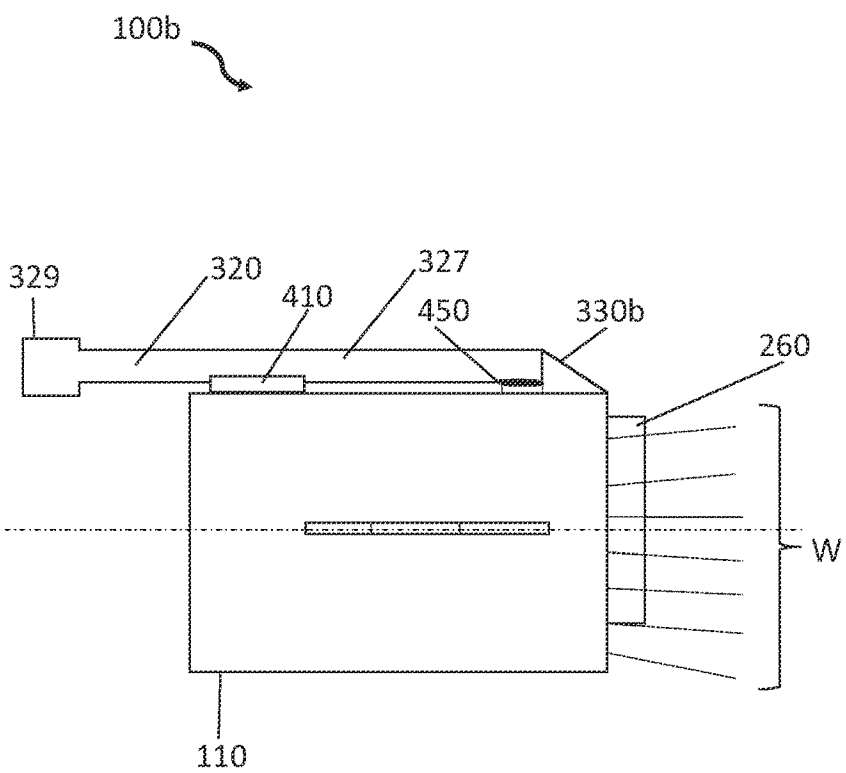
FIGS. 4A and 4B are side elevation views of the washover tools with the rod members, stabilization members, and a plurality of fluid jets spraying from the washover tools, according to one or more embodiments.
Figure 4A:
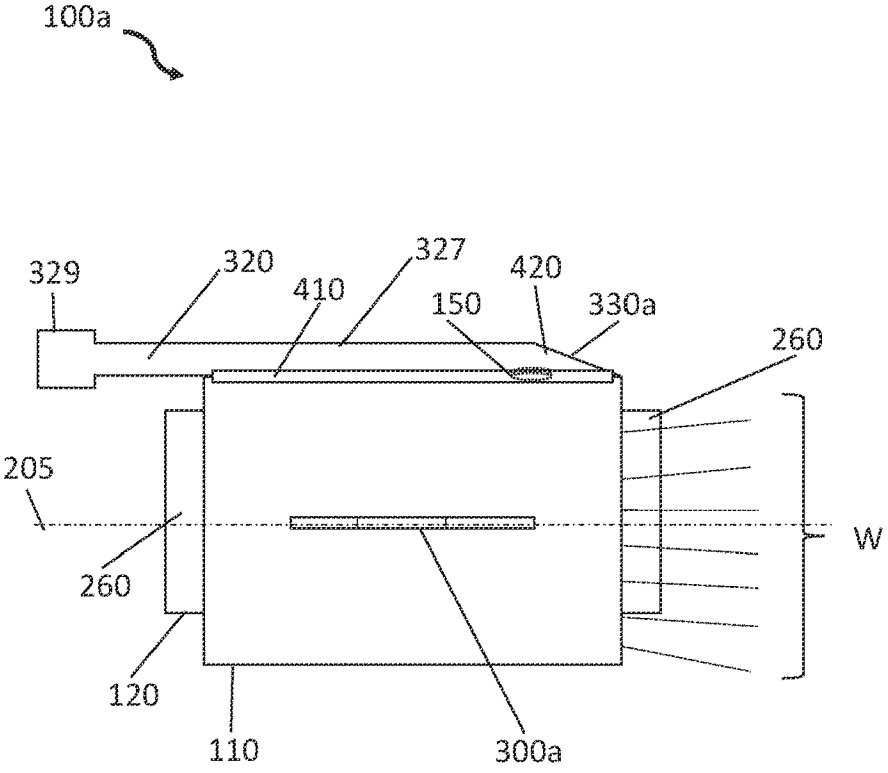

FIGS. 4A and 4B are side elevation views of the washover tools 100*a*, 100*b* with the rod member 320 and a plurality of fluid jets W spraying from the washover tools 100*a*, 100*b*, according to one or more embodiments. The washover tools 100*a*, 100*b*, may include one or more rod member supports 410 coupled between the elongated body 327 of the rod member 320 and the outer housing 110. The rod member supports 410 provide additional support to the rod member 320 to prevent lateral rotation of the rod member 320 during operations. In some embodiments, the rod member supports 410 are the same length as the length L1 of the outer housing 110. In another embodiment, the rod member supports 410 are have a length less than the length L1 of the outer housing 110. The rod member supports 410 may be welded to both the rod member 320 and the outer housing 110.

In some embodiments, the elongated body 327 of the rod member 320 is disposed on and coupled directly to the outer housing 110 as illustrated in the washover tool 100*a* of FIG. 4A. The rod member 320 of the washover tool 100*a* has a tapered end 420 so that the rod member 320 is in contact with the outer housing 110 along the entire length L1 of the outer housing. The cap 330*a* is coupled to the tapered end 420. FIG. 4A further illustrates the alignment of the opening 115 of the outer housing 110 and the opening 315 of the rod member 320. The alignment of the openings 115, 315 provides for the fluid communication between the rod member 320 and the annulus 220. The openings 115, 315 are axially aligned and are sealed together to form a single fluid chamber between the annulus 220 and the bore of the rod member 320.

In some embodiments, the elongated body 327 of the rod member 320 is coupled to the outer housing 110 via a connection member 450 as illustrated in the washover tool 110*b* of FIG. 4B. The connection member 450 is a cylindrical pipe with a bore formed therethrough. The connection member 450 may be axially aligned and formed within the opening 115 of the outer housing 110. The opening 315 of the rod member 320 may be aligned with and coupled to the connection member 450, so as to provide fluid communication between the rod member 320 and the annulus 220 through the connection member 450. The rod member 320 has one or more rod member supports 410 formed between the elongated body 327 and the outer housing 110 to provide support to the rod member 320 during operation of the washover tool 100*b*.

FIGS. 4A and 4B illustrate the plurality of fluid jets W being sprayed from the washover tools 100*a*, 100*b*. Pressurized fluid, such as a water, is supplied to the washover tools 100*a*, 100*b* and carried to the annulus 220 by the rod member 320. The pressurized fluid is then sprayed from the annulus 220 through the plurality of openings 240 in the form of fluid jets W along and/or about the center axis 205. The number of fluid jets W from the washover tools 100*a*, 100*b* is equal to the number of openings 240 formed in the front face plate 230. The fluid jets W washover the pipe 130.

FIGS. 4A and 4B further illustrate the washover tools 100*a*, 100*b* having the outer edge 260 of the inner housing 120 extending past the front face plate 230. In such embodiments, the inner housing 120 has a length L2 greater than the length L1 of the outer housing 110, such that the outer edge 260 and front surface 265 of the inner housing 120 extend past the front face plate 230. The front surface 265 and the outer edge 260 provide for additional ground removal during washover operations of the washover tools 100*a*, 100*b*. Similarly, the inner housing 120 may extend past the back face plate such that the outer edge 260 extends past the back face plate. In some embodiments, the back face plate completely covers the rear or back ends of the inner housing 120 and the outer housing 110.

Figure 5:
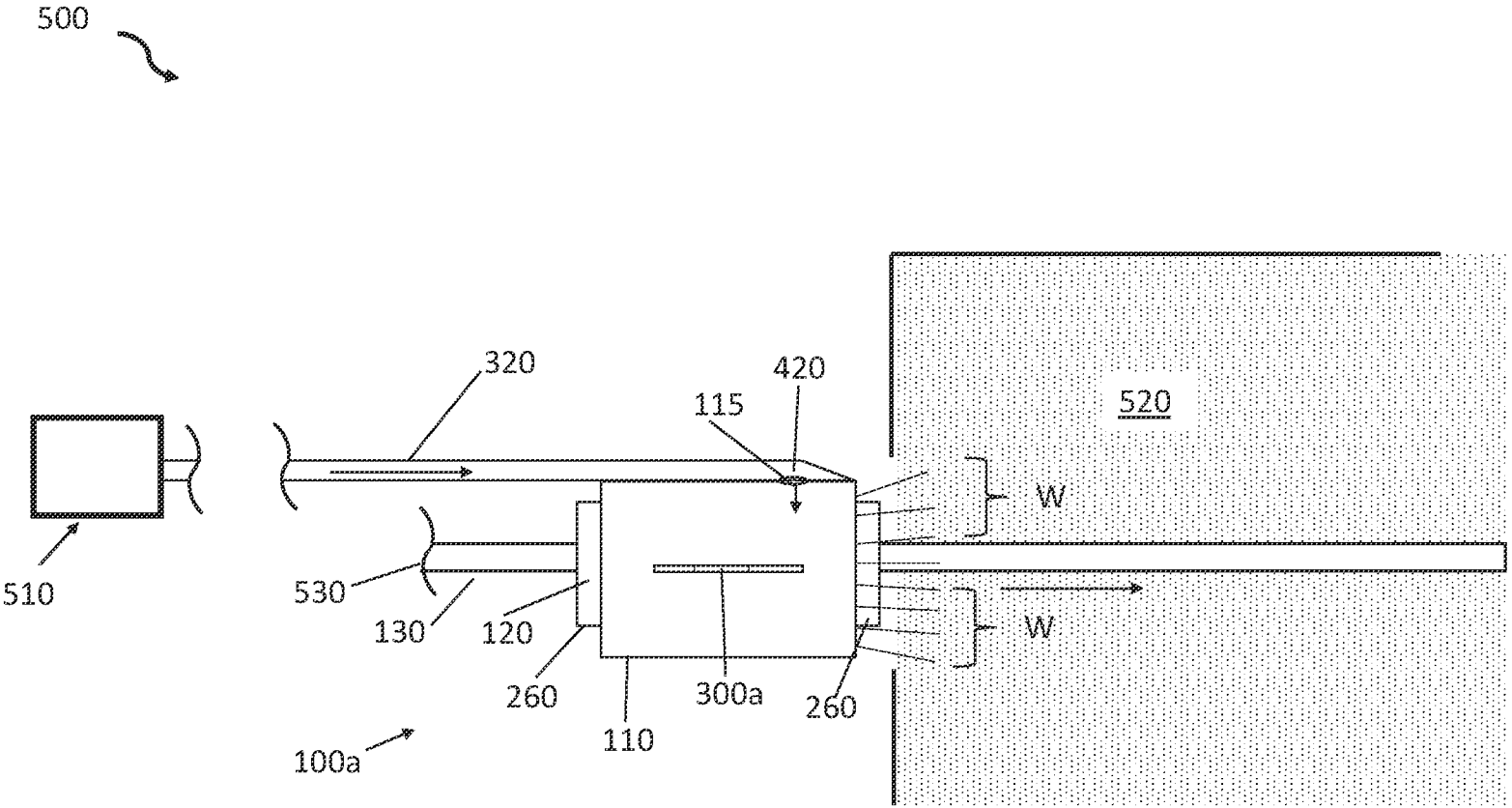
FIG. 5 is a schematic side view of a washover system in operation to remove a pipe from the ground, according to one or more embodiments.

FIG. 5 is a schematic side view of a washover system 500 in operation to remove the pipe 130 from the ground 520, according to one or more embodiments. The washover system 500 includes the washover tool 100*a* (but may similarly include the washover tool 100*b* or any other embodiments of the washover tools described herein) and a control source 510. The control source 510 supplies the fluid, such as washover water to the washover tool 100. Furthermore, the control source 510 provides power to move the washover tool 100*a* along the length of the pipe 130 and into the ground 520 by pushing on the rod member 320. In some embodiments, the control source 510 is configured to disconnect from the washover tool 100*a* and reconnect to the pipe 130 to remove the pipe 130 from the ground 520 after the pipe 130 has been washed over with the washover tool 100*a*, and while the washover tool 100*a* remains on the pipe 130 The ability to disconnect and reconnect from the washover tool 100*a* and the pipe 130 without having to completely remove the washover tool 100*a* increases the efficiency and decreases the cost of the pipe removal operations by limiting the operation time normally associated with removing one or more tools from the control source and/or the pipe 130 before attempting to remove the pipe 130 from the ground.

The rod member 320 of the washover tool 100 connects to the control source 510 to receive a fluid, such as washover water, from the control source 510. As discussed, the rod member 320 is coupled to the top side 117 of the outer housing 110 so that the opening 115 of the outer housing 110 and the opening 315 of the rod member 320 are aligned. The bore of the rod member 320 and the annulus 220 are in fluid communication, allowing pressurized fluid to be supplied to the washover tools 100*a*, 100*b* from the control source 510. The fluid flows through the rod member 320, into the annulus 220, and out of the plurality of openings 240 to washover the pipe 130.

The washover system 500 removes the pipe 130 embedded in the ground 520. The ground 520 may be any earth-like material, such as a sand or soft clay. The pipe 130 may extend some distance into the ground 520, thus requiring the washover tool 100*a* to be moved along the pipe 130 and into the ground 520 to remove any earth material surrounding the pipe 130. As the washover tool 100 extends farther into the ground 520, additional pipe members may be fastened the rod member 320 by the control source 510 to provide continuous fluid communication between the control source 510 and the washover tool 100*a*. As each additional pipe member is added to the washover system 500, the control source 510 supplies power to move the washover tool 100 along the length of the pipe 130 by pushing the pipe members connected to the rod member 320, while simultaneously providing pressurized fluid to washover the pipe 130.

The pressurized fluid is carried by the pipe members and the rod member 320 into the annulus 220 and ejected from the annulus 220 through the plurality of openings 240 formed in the front face plate 230. The plurality of openings 240 form a plurality of water jets W, which remove any ground 520 surrounding the pipe 130. The water jets W loosen the ground 520 around the pipe 130 and allow the source 510 to remove the pipe 130.

In some embodiments, the outer edge 260 and front surface 265 of the inner housing 120 remove additional ground 520 surrounding the pipe 130 as they contact the ground 520. As the washover tool 100 is moved along the pipe 130, the front surface 265 extending past the front face plate 230 loosens the ground 520 immediately surrounding the pipe 130. Simultaneously or after, pressurized fluid is supplied to the washover tool 100*a* to washover the pipe 130 and remove additional ground 520 around the pipe 130. This process repeats along the length of the pipe 130 until the pipe 130, or a section thereof, can be removed from the ground 520.

Figure 6:
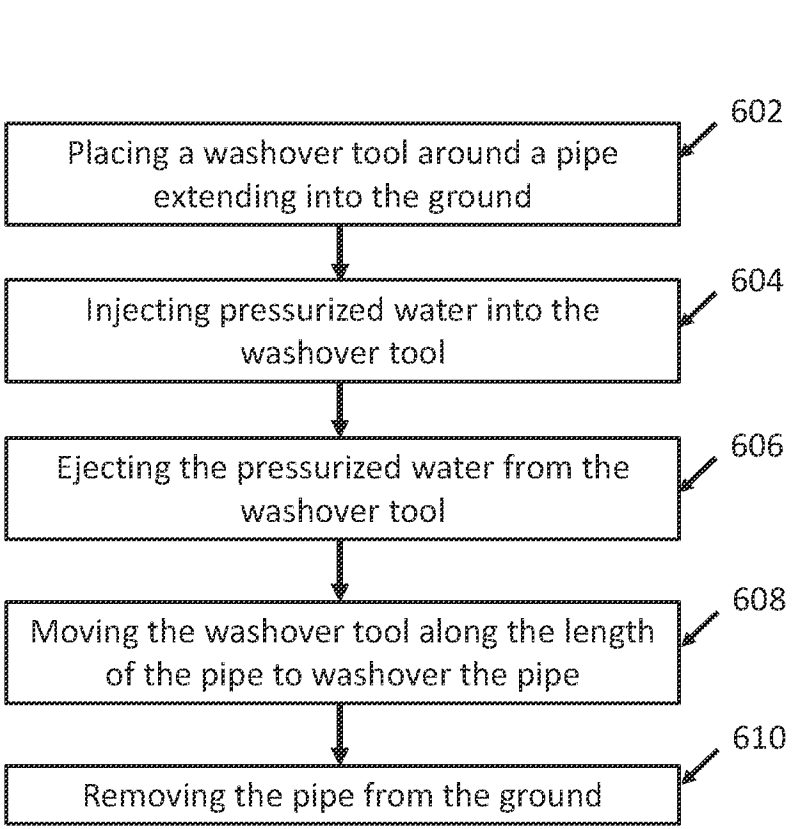
FIG. 6 is a flow chart illustrating a method of using a washover tool, according to one or more embodiments.

FIG. 6 is a flow chart illustrating a method 600 of using the washover system 500, according to one or more embodiments. Operation 602 of the method 600 comprises placing the washover tool (such as washover tools 100*a*, 100*b*) around the pipe 130 extending into the ground 520. In operation 602, the washover tool is placed around the pipe 130 at a location where a starting end 530 of the pipe 130 is exposed from the ground 520.

At operation 604, pressurized water is injected into the washover tool. The pressurized water is supplied from the control source 510 through the rod member 320, or through a series of additional pipe members coupled between the rod member 320 and the control source 510. At operation 606, the pressurized water is ejected from the washover tool through a plurality of openings 240 formed in the washover tool to washover the pipe 130. During operation 606, the pressurized water may be continuously ejected from the washover tool until a requisite amount of the ground 520 is removed from the area surrounding the pipe 130 while the washover tool remains in a stationary position.

At operation 608, the washover tool is then moved along the length of the pipe 130 to washover the pipe 130 with the pressurized water to remove the ground 520 surrounding the pipe 130. In some embodiments, the front surface 265 of the inner housing 120 also removes the ground 520 surrounding the pipe 130 as the washover tool is moved along the length of the pipe 130.

Finally, at operation 610, the pipe 130 is removed from the ground 520. Operation 610 includes disconnecting the washover tool system from the control source 510 by decoupling the rod member 320, or the series of pipe members coupled to the rod member 320, from the control source 510. The control source 510 is then coupled (such as by a threaded coupling) to the starting end 530 of the pipe 130. The control source 510 then applies a pulling force on the pipe 130 to remove the pipe 130 from the ground 520. If the pipe 130 is not sufficiently loosened from the ground 520, the control source 510 is recoupled to the washover tool system, and operations 602 through 610 are repeated until the pipe 130 may be removed from the ground 520.

The embodiments of the washover tools 100, 100*a*, 100*b*, the washover system 500, and the method 600 of using the washover tools and system can be equally used to remove pipes, such as drill pipe, that gets stuck in a wellbore when drilling oil and gas wells from a drilling rig. The washover tools 100, 100*a*, 100*b* can be placed over the stuck pipe, which may be oriented vertically, and moved along the pipe down into the wellbore while spraying high pressure fluid to remove any dirt, debris, or the materials from around the pipe. The pipe can then be removed and the drilling operation resumed. The embodiments of the washover tools 100, 100*a*, 100*b*, the washover system 500, and the method 600 of using the washover tools and system are not limited to use in pipeline and oil and gas drilling operations, but can equally be used in any other type of applications and industries where pipe removal may be needed.

It is contemplated that one or more of the embodiments disclosed herein may be combined. Moreover, it is contemplated that one or more of these embodiments may include some or all of the aforementioned benefits.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

The invention claimed is:

1. A washover tool, comprising:

an outer housing;

an inner housing disposed within the outer housing, wherein an annulus is formed between an outer surface of the inner housing and an inner surface of the outer housing;

a front face plate coupled to the inner and outer housings, wherein the front face plate covers an end of the annulus and extends at least from the outer surface of the inner housing to the inner surface of the outer housing; and a rod member coupled to the outer housing and configured to supply pressurized fluid to the annulus, which pressurized fluid is then ejected through a plurality of openings formed in the front face plate to washover a pipe extending through the inner housing and at least partially buried in the ground.

2. The washover tool of claim 1, wherein a front end of the inner housing extends beyond the front face plate.

3. The washover tool of claim 1, further comprising:

at least one opening formed in a top side of the outer housing; and at least one opening formed in the rod member, wherein the at least one opening of the outer housing is in fluid communication the least one opening of the rod member.

4. The washover tool of claim of claim 1, further comprising a plurality of stabilizing members coupled to the outer housing, wherein the plurality of stabilizing members are configured to prevent the washover tool from rotating about a central axis.

5. The washover tool of claim 4, wherein the plurality of stabilizing members are rounded in shape.

6. The washover tool of claim 4, wherein the plurality of stabilizing members are triangular in shape.

7. The washover tool of claim 1, wherein the rod member coupled to the outer housing is disposed on an outer surface of the outer housing.

8. The washover tool of claim 1, further comprising a back face plate disposed on an opposite end of the washover tool from the front face plate thereby enclosing the annulus between the outer housing and the inner housing.

9. The washover tool of claim 1, wherein the front face plate is attached to an end of the outer housing and to the outer surface of the inner housing.

10. The washover tool of claim 1, wherein the front face plate is attached to an end of the outer housing and an end of the inner housing.

11. A washover system, comprising:

a control system; and a washover tool, wherein the washover tool comprises:

an outer housing comprising an inner surface;

an inner housing comprising an outer surface, the inner housing disposed within the outer housing, an annulus formed between the outer surface of the inner housing and the inner surface of the outer housing;

a front face plate coupled to the inner and outer housings, wherein the front face plate covers an end of the annulus and extends at least from the outer surface of the inner housing to the inner surface of the outer housing; and a rod member coupled to the outer housing and configured to supply pressurized fluid to the annulus, which pressurized fluid is then ejected through a plurality of openings formed in the front face plate to washover a pipe extending through the inner housing and at least partially buried in the ground;

wherein the control system is configured to supply the pressurized fluid to the rod member and move the washover tool along the pipe.

12. The washover system of claim 11, wherein the control system is configured to couple to the pipe at least partially buried in the ground and remove the pipe from the ground.

13. The washover system of claim 11, wherein the washover tool includes a plurality of stabilizing members coupled to the outer housing to prevent the washover tool from rotating relative to the pipe.

14. The washover system of claim 11, wherein the rod member coupled to the outer housing is disposed on an outer surface of the outer housing.

15. The washover system of claim 11, further comprising a back face plate disposed on an opposite end of the washover tool from the front face plate thereby enclosing the annulus between the outer housing and the inner housing.

16. The washover system of claim 11, wherein the front face plate is attached to an end of the outer housing and to the outer surface of the inner housing.

17. The washover tool of claim 11, wherein the front face plate is attached to an end of the outer housing and an end of the inner housing.

18. A method of using a washover tool to remove a pipe at least partially buried in the ground, comprising:

placing the washover tool around the pipe, wherein the washover tool comprises:

an outer housing;

an inner housing disposed within the outer housing and forming an annulus between the inner and outer housings, wherein at least a portion of the pipe extends through the inner housing when the washover tool is placed around the pipe;

a front face plate coupled to the inner and outer housings; and a rod member coupled to the outer housing and configured to supply a pressurized fluid to the annulus;

injecting the pressurized fluid into the washover tool by supplying the pressurized fluid from a control system to the annulus of the washover tool through the rod member;

ejecting the pressurized fluid from a plurality of openings formed in the front face plate of the washover tool to washover the pipe;

moving the washover tool along the length of the pipe to washover the pipe by pushing the rod member with the control system; and removing the pipe from the ground, wherein the removing comprises:

disconnecting the control system from the washover tool;

connecting the control system to the pipe; and pulling the pipe from the ground with the control system.

19. The method of claim 18, wherein disconnecting the control system from the washover tool comprises disconnecting the rod member from the control system.

20. The method of claim 18, wherein the inner housing extends beyond the outer housing and the inner housing removes the ground while moving the washover tool along the length of the pipe.

* * * * *